US006908021B1

(12) United States Patent
Wang

(10) Patent No.: US 6,908,021 B1
(45) Date of Patent: Jun. 21, 2005

(54) SAFETY CATCH MECHANISM OF NAIL GUNS

(75) Inventor: Guan-He Wang, Ta-Li (TW)

(73) Assignee: Nailermate Enterprise Corp., Ta-Li (TW)

( * ) Notice: Subject to any disclaimer, the term of this patent is extended or adjusted under 35 U.S.C. 154(b) by 0 days.

(21) Appl. No.: 10/772,729

(22) Filed: Feb. 4, 2004

(51) Int. Cl.[7] ..... B25C 7/00
(52) U.S. Cl. ..... 227/8; 227/120
(58) Field of Search ..... 227/8, 120, 130, 227/121, 125, 127, 135, 136

(56) References Cited

U.S. PATENT DOCUMENTS 4,264,028 A * 4/1981 Austin ..... 227/8
4,597,517 A * 7/1986 Wagdy ..... 227/8
4,932,580 A * 6/1990 Pfister et al. ..... 227/10
5,829,661 A * 11/1998 Hirtl et al. ..... 227/10
6,267,284 B1 * 7/2001 Clark ..... 227/8
6,708,860 B1 * 3/2004 Thieleke ..... 227/8
6,761,299 B2 * 7/2004 Caringella et al. ..... 227/10

* cited by examiner

*Primary Examiner*—Rinaldi I. Rada
*Assistant Examiner*—Paul Durand
(74) *Attorney, Agent, or Firm*—Charles E. Baxley

(57) ABSTRACT

A safety catch mechanism for nail guns comprises a through hole at the upper end of a magazine of the nail gun, an axle section protruded from one side of the magazine and pivotally coupled with a rotary rod, a blocking arm extended from the rear end of the rotary rod, a blocking plate bent from the rear end of the blocking arm for being extended and blocking the rear of the trigger; wherein a push arm is extended from the front end of the rotary rod; a limit bracket is movably embedded at the end of the push arm; a latch is defined on the limit plate to be protruded from an inner wall of the magazine; by means of the foregoing structure, if the magazine is loaded with nails, the latch can be pushed outward to drive the rotary rod to rotate, so that the blocking plate is separated from the rear of the trigger and allows users to cock the trigger.

6 Claims, 4 Drawing Sheets

SAFETY CATCH MECHANISM OF NAIL GUNS

FIELD OF THE INVENTION

The present invention relates to a nail gun assembly, more particularly to a nail gun assembly with a safety catch mechanism for preventing users from shooting the nail gun without nails.

BACKGROUND OF THE INVENTION

In general, a prior-art nail gun usually comprises a muzzle disposed at the front end of a nailing device in the main body of the nail gun, a magazine interconnectably disposed at the bottom of the muzzle for accommodating and storing nails. Further, a trigger is disposed on the handle of the main body of the nail gun for controlling the high-pressure airflow inside the nail gun and a firing pin of the nail gun for the shooting. By the shooting force of the firing pin, the nail in the muzzle can be shot into a work piece.

However, when users use such prior-art nail gun, the nails are shot continuously without knowing the current quantity of nails in the magazine. Therefore, after the nails in the magazine are exhausted, users may continue to cock the trigger. Some users even cock the trigger for several times intentionally to make sure there is no nail in the magazine before reloading the magazine with nails. As to the structure of the nail gun, shooting by a firing pin or other firing device without nails in the magazine may have adverse effects on the life of the nail gun or even cause damages to the nail gun.

SUMMARY OF THE INVENTION

The primary objective of the present invention is to provide a safety catch mechanism for preventing users from shooting without nails in the magazine. By means of a blocking plate and a rotary rod, if there is no nail in the magazine, the blocking plate will block the rear of the trigger and prevent the trigger from being cocked. If the magazine is loaded with nails, then the latch can be pushed to drive the push arm to rotate outward, such that the blocking plate is separated from the rear of the trigger, and thus allowing users to cock the trigger. Therefore, the present invention can effectively prevent user from shooting a nail gun without nails in the magazine, and thus preventing the structure of the firing device and firing pin from being damaged or the life of use shortened due to the firing without having nails in the magazine.

The technical measures taken by the invention to overcome the aforementioned shortcomings are given below:

A safety catch mechanism for preventing a nail gun from shooting without nails in the magazine comprises:

a main body, having a trigger disposed on a handle of said main body, a muzzle disposed at the front end of the main body, and a magazine interconnectably disposed at the bottom of the muzzle; wherein a through hole is disposed on the upper wall of the magazine and an axle section protruded from one side of the magazine;

a rotary rod, being movably disposed on the axle section, and having a push arm extended from the front end of the rotary rod, an embedding plate being bent from the front end of the push arm, an embedding groove disposed on the embedding plate, a blocking arm extended from the rear of the rotary rod and bent in the direction towards the trigger, and a blocking plate being bent from the rear end of the blocking arm and extended to the rear of the trigger; and a limit plate, being movably passed into the through hole of the magazine, and one end of the limit plate being movably embedded into the embedding groove of the rotary rod, wherein the limit plate forms a latch protruded from an inner wall of the magazine.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
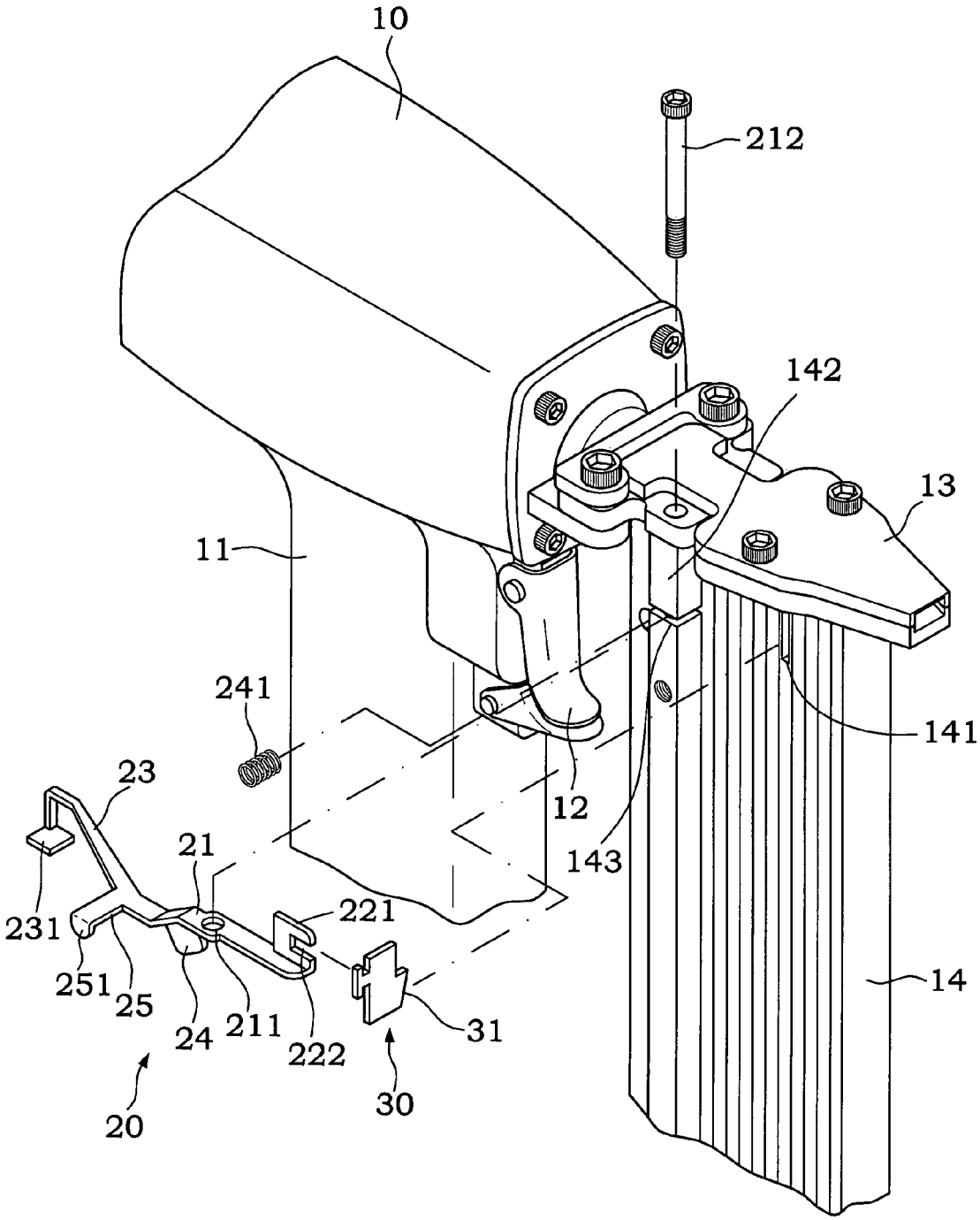
FIG. 1 is an exploded view of the safety catch mechanism of the present invention.
Figure 2:
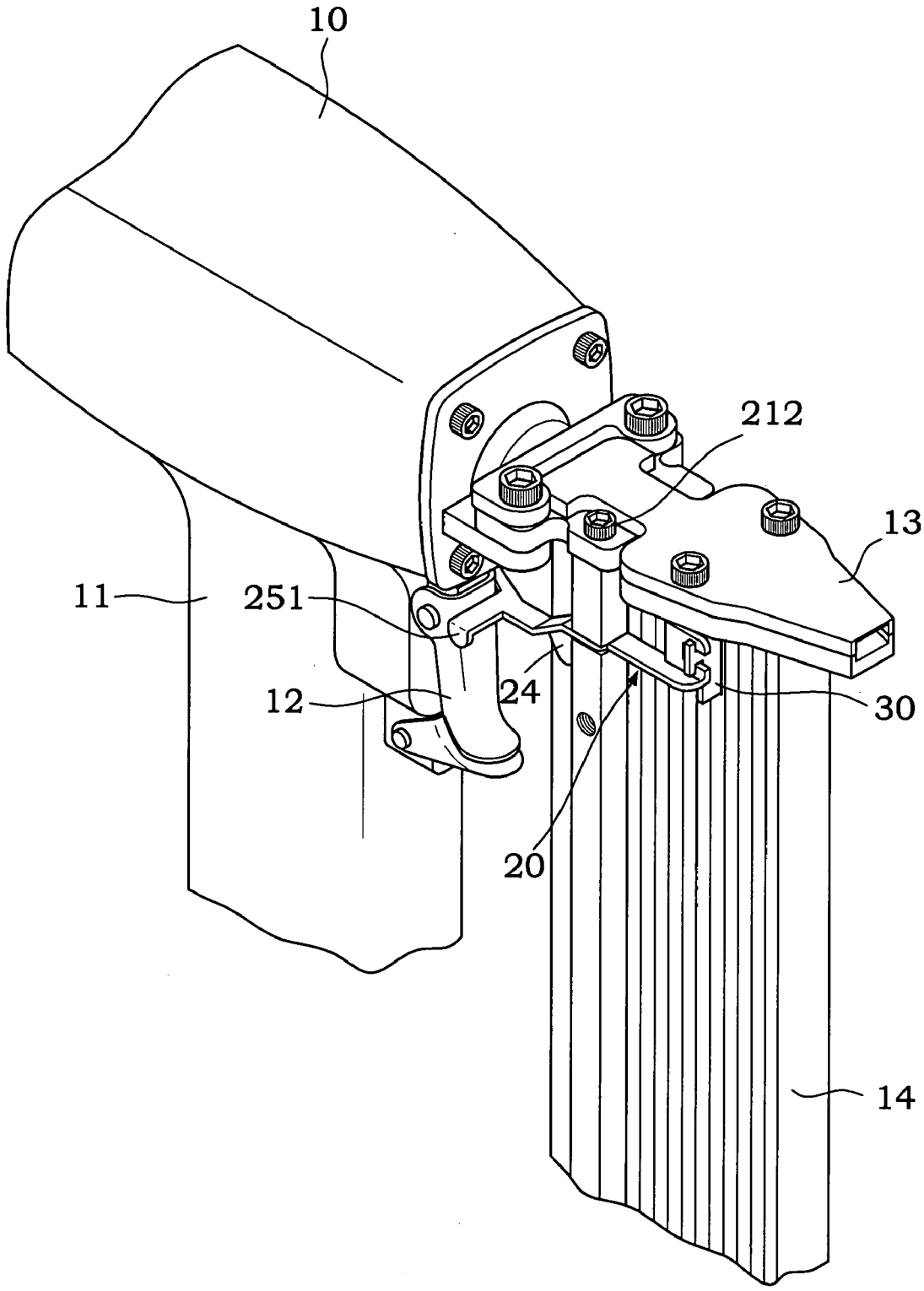
FIG. 2 is a view of the safety catch mechanism of the present invention.
Figure 3:
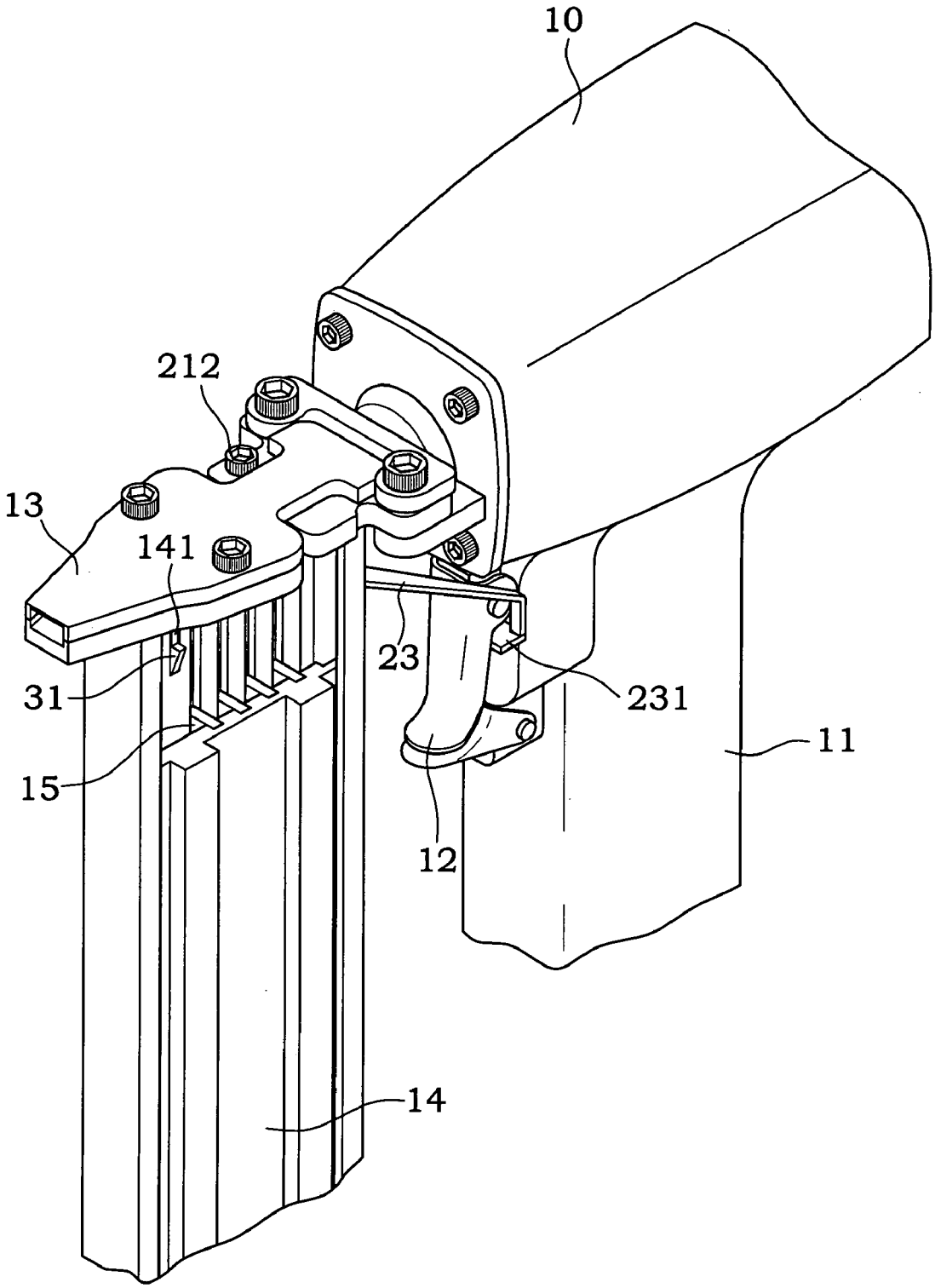
FIG. 3 is another view of the safety catch mechanism of the present invention.

Please refer to FIGS. 1 to 3 for a safety catch mechanism of the present invention, which comprises:

a main body 10, having a trigger 12 disposed on a handle 11, and a muzzle 13 disposed at the front end of the main body 10, a magazine 14 disposed under the muzzle 13 and interconnected with the muzzle 13, and a nail feeder 15 disposed in the magazine 14 for continuously pushing the nails stored in the magazine 14 out towards the muzzle 13; wherein a through hole 141 is disposed on an upper wall of the magazine 14; an axle section 142 is protruded from a side of the magazine 14; and a transversal groove 143 is transversally disposed on the axle section 142;

a rotary rod 20, disposed on an axial section 21, and the axial section 21 having an axial hole 211 in the middle for allowing a screw rod 212 to pass through, and the axis of the rotary rod 20 being fixed in the transversal groove 143 of the axle section 142; a push arm 22 being extended forward from the front end of the axial section 21; an embedding plate 221 bent from the front end of the push arm 22; an embedding groove 222 disposed on the embedding plate 221; a blocking arm 23 being bent and extending in an aslant direction from the rear end of the axial section 21 towards the trigger 12; a blocking plate 231 being bent from the rear end of the blocking arm 23 and extended to the rear of the trigger 12; wherein a spring bracket 24 is disposed on an inner side of the rotary rod 20, and a spring 241 is embedded in a position corresponding to a sidewall of the magazine 14 for providing the resilience for the rotary rod 20; further, a press arm 25 is extended from the rotary rod 20 having a press button 251 bent from the end of the press arm 25;

a limit plate 30, movably passing into the through hole 141 of the magazine 14 and one side of the limit plate 30 being movably embedded into the embedding groove 222 of the rotary rod 20; wherein the limit plate 30 forms a latch 31 protruded from the inner wall of the magazine 14.

Figure 4:
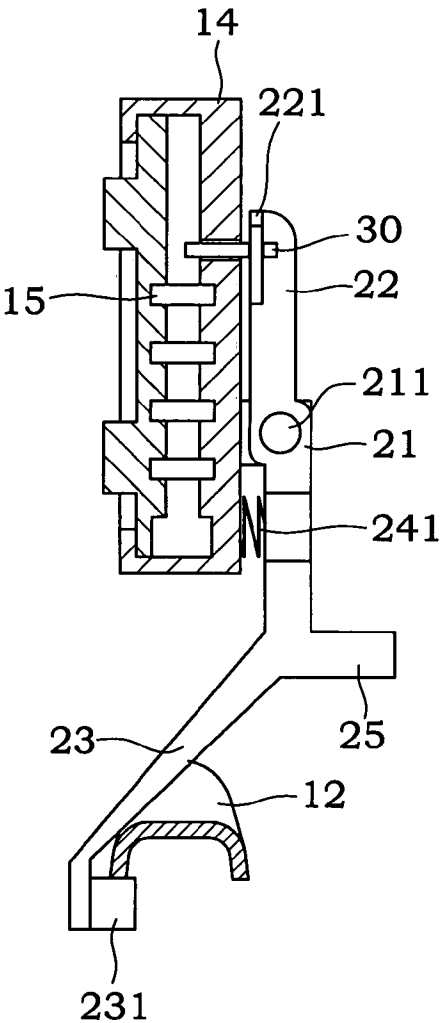
FIG. 4 is a view of the movements of the safety catch mechanism of the present invention.

Accompanied with the description of the foregoing structure, the principle of the movements for this invention is elaborated as follows:

Please refer to FIG. 4 for the invention. If there is no nail in the magazine 14, the spring bracket 24 of the rotary rod 20 will push the limit plate 30 towards the magazine 14 by a resilient force of the spring 241, and then the blocking plate 231 will block the rear of the trigger 12, such that if there is no nail in the magazine 14, the blocking plate 231 will automatically block the rear of the trigger 12 to set the rotary rod 20 at a safety protection mode, and thus users cannot cock the trigger 12. Such arrangement prevents the nail gun from being shot when there is no nail in the magazine, and thus protecting the structures including the firing device and the firing pin from being damaged by shooting without nails in the magazine or preventing the shortened life of use.

Figure 5:
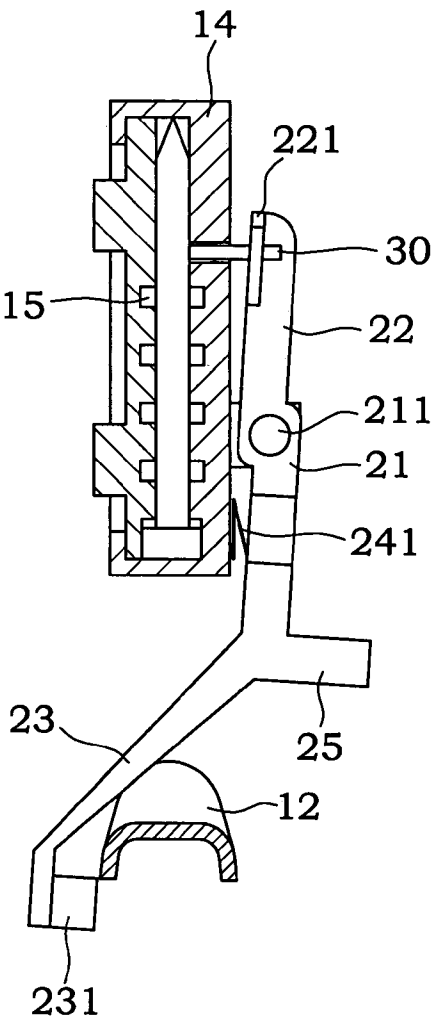
FIG. 5 is another view of the movements of the safety catch mechanism of the present invention.

If nails are loaded in the magazine 14, the nail feeder 15 in the magazine will continuously push the stored nails towards the muzzle 13. When a nail is pushed to the top of the magazine 14 (as shown in FIG. 5), the nail will automatically push the latch 31 out from the magazine 14 and drive the rotary rod 20 to rotate, and the blocking plate 231 will be separated automatically from the rear of the trigger 12 and switched to a free shooting mode, such that a user can freely cock the trigger to shoot out a nail in the magazine 14.

Further, accompanied with the disposition of the press arm 25 and the press button 251, after the last nail in the magazine 14 enters into the muzzle 13, there will be no nail in the magazine 14 to press the latch 31, and thus the rotary rod 20 will resume its original position by the resilient force pushed by the spring 241, and the blocking plate 231 will block the rear of the trigger 12 and return to the safety protection mode, which causes the situation of unable to shoot the last nail. Users may manually press the press button 251 of the rotary rod 20 to separate the blocking plate 231 and manually switch the rotary rod to the free shooting mode for the shooting. Alternatively, if a nail in the magazine 14 is stuck or has other situations, users may make use of the press button 251 to cock the trigger and eliminate the failing conditions.

In summation of the above description, the present invention enhances the performance of the conventional structure, and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A nail gun with a safety catch mechanism comprising:

a main body, having a trigger disposed on a handle of said main body, a muzzle disposed at the front end of said main body, and a magazine interconnectably disposed under said muzzle; wherein a through hole being disposed on an upper wall of said magazine and an axle section protruded from a sidewall of said magazine;

said safety catch mechanism further comprising:

a rotary rod, movably disposed on said axle section and having a push arm extended from the front end of said rotary rod, an embedding plate bent from the front end of said push arm, an embedding groove disposed on said embedding plate, a blocking arm bent and extended from the rear end of said rotary rod in the direction towards said trigger, a blocking plate bent from the rear end of said blocking arm and extended to the rear of said trigger;

a limit plate, movably passing into said through hole of said magazine, and one side of said limit plate being movably embedded into said embedding groove of said rotary rod; wherein said limit plate forming a latch protruded from an inner wall of said magazine;

when said magazine no longer having nails therein, said blocking plate blocking the rear of said trigger to prevent a firing pin to shoot a nail; when said magazine being loaded with nails, said latch being pushed outward to drive said rotary rod to rotate, such that said blocking plate being separated from the rear of said trigger and allowing users to cock said trigger.

2. The nail gun of claim 1, wherein said rotary rod comprises an axial section and an axial hole disposed at the middle of said axial section.

3. The nail gun of claim 2, wherein said axle section comprises a transversal groove thereon for accommodating said axial section of said rotary rod.

4. The nail gun of claim 3, wherein said axle section further comprises a screw rod to pass through said axial hole of said rotary rod, and the axis of said rotary rod is fixed in said transversal groove.

5. The nail gun of claim 1, wherein said rotary rod comprises a spring bracket thereon, and a spring is embedded into a sidewall of said magazine for providing a resilient force to said rotary rod.

6. The nail gun of claim 1, wherein said rotary rod comprises a press arm thereon, and a press button is defined by being bent from an end of said press arm.

* * * * *